US006382074B1

(12) United States Patent
Migliori

(10) Patent No.: US 6,382,074 B1
(45) Date of Patent: May 7, 2002

(54) PNEUMATIC CYLINDER WITH DAMPING DEVICE

(76) Inventor: Luciano Migliori, Viai F. lli Cervi, Residenza del Sagittario 29/1, 20090 Milan 2- Segrate (MI) (IT)

( * ) Notice: Subject to any disclaimer, the term of this patent is extended or adjusted under 35 U.S.C. 154(b) by 0 days.

(21) Appl. No.: 09/537,258

(22) Filed: Mar. 29, 2000

(30) Foreign Application Priority Data

Mar. 29, 1999 (IT) ..... MI99A0640

(51) Int. Cl.[7] ..... F15B 15/22
(52) U.S. Cl. ..... 91/395; 91/405
(58) Field of Search ..... 91/395, 405, 394

(56) References Cited

U.S. PATENT DOCUMENTS

| | | | | |
|---|---|---|---|---|
| 1,604,548 A | * | 10/1926 | Dapron | 91/395 |
| 1,891,312 A | * | 12/1932 | Knecht | 91/395 |
| 2,556,698 A | * | 6/1951 | Loewe | 91/395 |
| 3,034,482 A | * | 5/1962 | Rader | 91/405 |
| 3,072,104 A | * | 1/1963 | Marsh | 91/394 |
| 3,157,095 A | * | 11/1964 | Heiser | 91/395 |
| 3,440,930 A | | 4/1969 | Olson | |
| 3,805,672 A | | 4/1974 | Pekrul | |
| 3,964,370 A | | 6/1976 | Rich | |
| 4,373,427 A | | 2/1983 | Garlapaty et al. | |
| 4,807,514 A | * | 2/1989 | Gartzmuller | 91/394 |
| 4,829,881 A | | 5/1989 | Taki et al. | |
| 4,852,465 A | | 8/1989 | Rosengren | |

FOREIGN PATENT DOCUMENTS

| | | |
|---|---|---|
| EP | 0 005 407 A1 | 11/1979 |
| EP | 0 082 829 B1 | 6/1983 |
| EP | 0 345 506 B1 | 12/1989 |
| EP | 0 648 941 A1 | 4/1995 |

* cited by examiner

*Primary Examiner*—F. Daniel Lopez
*Assistant Examiner*—Igor Kershteyn
(74) *Attorney, Agent, or Firm*—Young & Thompson

(57) ABSTRACT

A pneumatic cylinder provided with a damping device to decelerate the piston inside a piston chamber at an end of its working stroke, while reducing the impact forces. The damping device comprises a restricted flow path for the fluid and a closing member for an inlet-outlet port which is supported by a helical spring extending from one end of the piston; an open cavity at the front end of the piston is designed to receive the closing member and/or the helical spring during damping at the end of the working stroke. Axially extending guide for the closing member are provided inside the piston chamber.

8 Claims, 7 Drawing Sheets

PNEUMATIC CYLINDER WITH DAMPING DEVICE

BACKGROUND OF THE INVENTION

The present invention relates to improvements to fluid actuated cylinders having a reciprocable piston member within a piston chamber, and more particularly relates to a fluid actuated damping device designed to decelerate the piston along an end portion of its working stroke, while reducing the impact forces of the piston against an end closing member of the piston chamber, at the reversal of the reciprocating movement. The invention in its various embodiments is applicable to single-acting or double-acting cylinders, both of the rod and of the rodless type.

The invention also relates to a cylinder of the kind referred to above, provided with a damping device designed to provide a prolonged deceleration effect, while keeping the same cylinder within standard dimensions.

PRIOR ART

In order to dampen and decelerate the reciprocating movement of a piston at the end of its working stroke, in hydraulic or pneumatic cylinders it is known to provide suitable pressure actuated damping means which intervene at the end of the piston stroke to prevent shock on the load connected to the cylinder or damage to the same; usually said damping means comprise a cylindrical or conical member axially extending from one end of the piston member and designed to protrude into a corresponding hole in an end member of the cylinder, so as to close a discharge outlet or define a flow passage through which the fluid under pressure is forced to pass towards a venting path for the same pressurized fluid which remains in the cylinder chamber during the final portion of the piston stroke.

Other known damping devices comprise suitable adjustable seals and needle valves for varying the air venting speed and deceleration speed of the piston.

Examples of cylinders provided with damping devices for controlling deceleration of the piston, are described in U.S. Pat. Nos. 3,440,930, 3,805,672, 3,964,370 and EP 0 005 407.

Other deceleration devices similar to those referred to above, in particular for rodless cylinders, may be found, for example, in EP 0 345 506, EP 0 082 829, U.S. Pat. Nos. 4,373,427, 4,829,881 and 4,852,465 which also illustrate the general features of a rodless cylinder.

In general, the prior known damping devices comprise a cylindrical member projecting from the piston or the closing end wall of the piston chamber to penetrate into a corresponding hole at the end of the piston stroke so as to close the direct supplying and discharging port for the fluid under pressure, allowing the said fluid to be vented through a restricted path in order to decelerate the piston.

These damping devices generally are necessary in many applications, not only in order to decelerate adequately the speed of the piston and the load connected to it, at the end of the working stroke, but also reduce the impact forces of the piston against the closing end wall, reducing the noise level thereof.

The damping devices of this kind, however, do not ensure a sufficiently effective damping effect and an adequate control of deceleration of the piston, in particular when rapid displacements of the piston are required or when the movable mass of the load to be stopped has a significant value, since they depend on the volume of fluid under pressure which can be ejected through the venting duct, during the end portion of the piston stroke.

Considering that the useful working stroke of a piston in standard cylinders cannot be modified, to improve damping by a conventional damping device it is necessary to increase the length of the deceleration stroke of the piston; this would inevitably result in an increase in the dimensions of the length of the whole cylinder, in respect to a standard one.

In an attempt to solve this problem, namely in the attempt to find a damping device for pneumatic cylinders which was able to provide a sufficiently long deceleration stroke, without increasing substantially the dimensions of the same cylinder, EP 0 648 941 proposes a particular damping device which can be used both with usual rod and with rodless cylinders, comprising a venting path which can be telescopically lengthened. However, this device also involves a considerable increase in the length of the cylinder, in addition to an extremely complex design which is difficult to apply to cylinders operating at high speeds. The length of the final stroke for the deceleration of the piston must also be suitably calculated during the designing, without any possibility for subsequent adjustments to modify or adapt the damping device.

OBJECTS OF THE INVENTION

The main object of the present invention is to provide a fluid actuated cylinder comprising a damping device to provide a controlled deceleration of the piston along a sufficiently long damping stroke, by using a consequent high volume of fluid to be vent or discharged through a restricted path, without negatively affecting the dimensions and working of the same cylinder.

A further object of the present invention is to provide a cylinder comprising a damping device, as referred to above, by means of which it is possible to keep the dimensions of the cylinder within standard values, achieving an improved deceleration of the piston and damping effect.

Yet another object of the present invention is to provide a cylinder with a damping device which is both constructionally simple and by means of which it is also possible to vary or modify the length of the deceleration portion of the piston stroke, during the designing of the cylinder, with the possibility also, in certain cases, of carrying out adjustments subsequently, during the assembling or the use.

Yet another object of the present invention is to provide a damping device for pneumatic cylinders as referred to above, which can be used both in cylinders with rods and in rodless cylinders, independently of the dimensions and the features of the cylinder itself.

The advantages which may be achieved with the present invention consist not only in the limitation of the overall dimensions of the cylinder and in a constructional simplification of the damping device, but also in the possibility of increasing the working speed of the piston, while maintaining, however, a high damping efficiency, in particular in cylinders of short-stroke type.

BRIEF DESCRIPTION OF THE INVENTION

In particular, according to a first aspect of the invention, a fluid actuated cylinder and a damping device has been provided, the cylinder comprising a cylindrical body defining an elongated piston chamber having an inlet and outlet port for pressurized fluid opening into the piston chamber at least one end thereof; a reciprocable piston member in said piston chamber; a closing member provided on the piston member for closing the fluid inlet and outlet port, the damping device comprising said closing member and a restricted flow path for discharging the pressurized fluid upon closure of said port, wherein said closing member is coaxially arranged and movably supported by a helical spring, in respect to the piston member, and in that said piston member comprises a front open cavity at one end to receive at least a rear portion of the closing member and the helical support spring upon closure of the inlet and outlet port by said closure member, during the final portion of the piston stroke.

According to another aspect of the invention, in particular for cylinders with rods, the spring for supporting the closing member is coaxially arranged to the piston rod and the same closing member is in annular form, being slidably and axially guided along the same rod of the piston member or along an extension thereof.

According to yet another aspect of the invention, in particular for rodless cylinders, the spring for supporting the closing members freely extends from the piston end, and the closing member is in the form of a plug member provided with a peripheral flange slidably guided by the internal surface of the cylinder.

BRIEF DESCRIPTION OF THE DRAWINGS

These and other features of some fluid actuated cylinders provided with a damping device according to the present invention, will emerge more clearly from the description which follows, with reference to the accompanying drawings, in which.

DETAILED DESCRIPTION OF THE INVENTION

Figure 1:
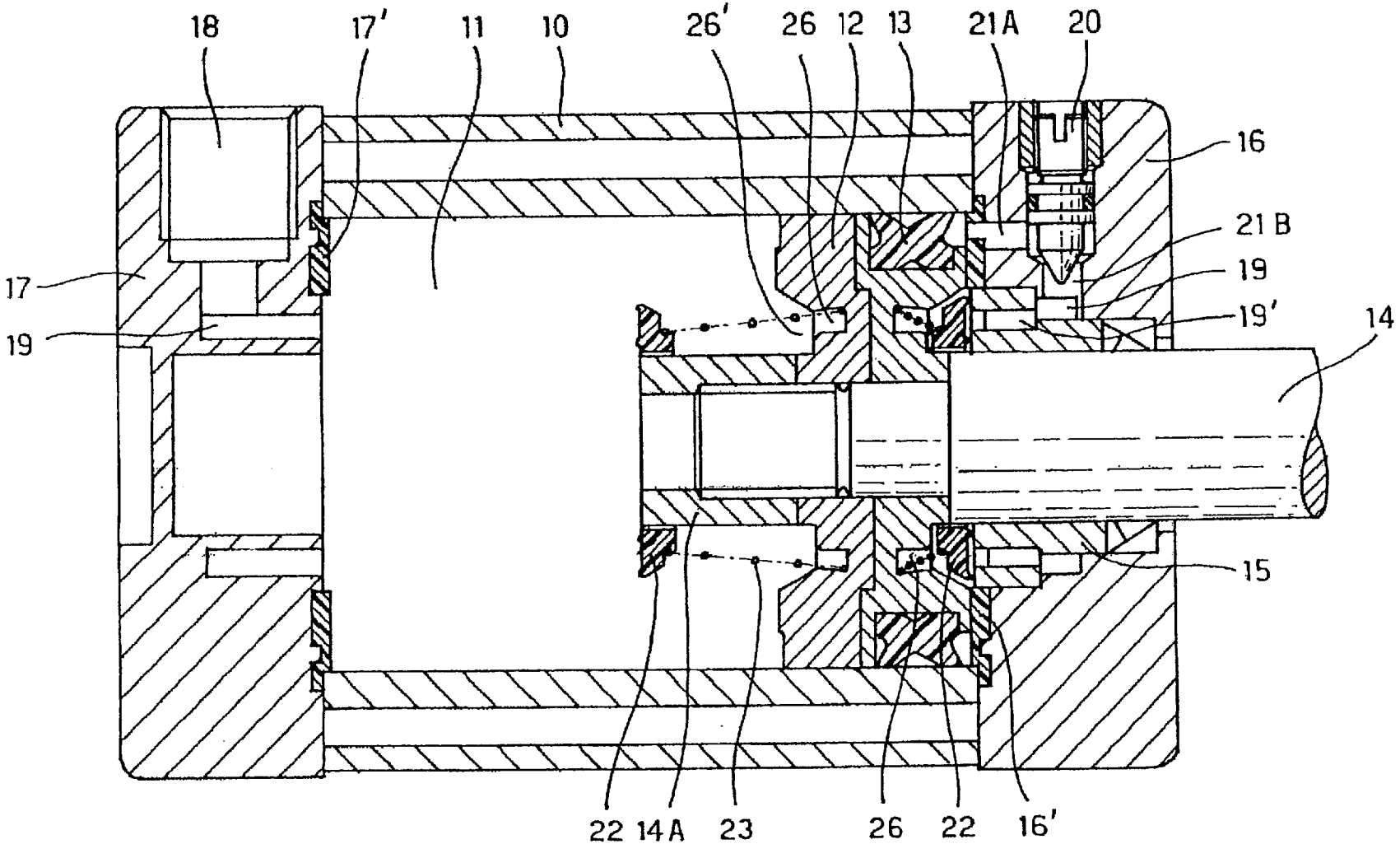
FIG. 1 is a longitudinal cross-section view along a rod cylinder, of the double-acting type, comprising a damping device according to the invention.

With reference to FIGS. 1 to 6 we shall now describe a first embodiment of a damping device according to the invention, for a pneumatic cylinder of the double-acting type; it is pointed out, however, that the invention is also applicable to single-acting cylinders, to rodless cylinders or to any linear pressure fluid actuators having different characteristics or different design.

Usually, a pneumatic cylinder of the double-acting type, comprises a tubular body 10 and end pieces 16, 17 to define an axially extending chamber 11 in which a piston member 12 reciprocates; the piston 12 is provided with one or more peripheral seals 13 sliding in contact with the internal surface of the piston chamber 11.

The piston 12, is in turn provided on one side with a rod 14 which sealingly emerges through an axial bore in the end piece 16, comprising a guide bush 15, as shown.

Figure 2:
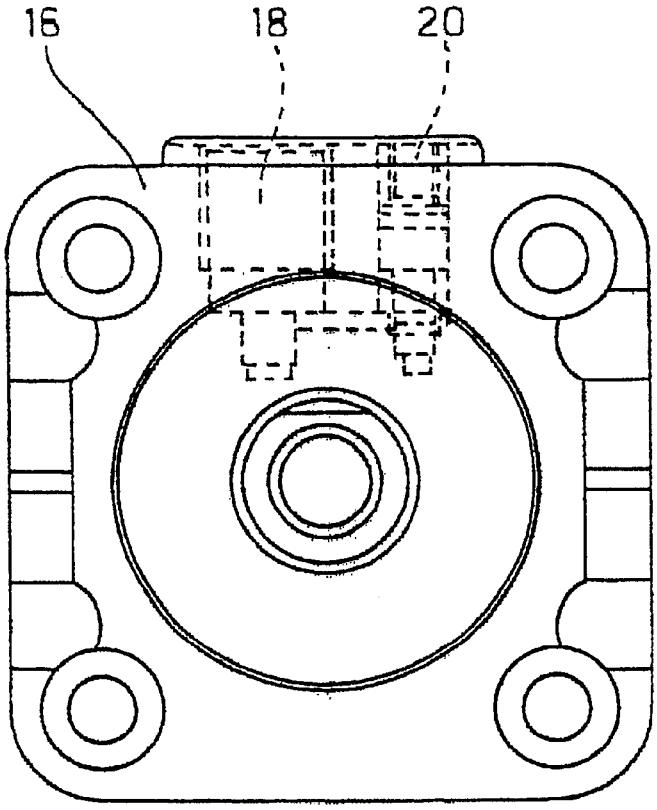
FIG. 2 is an end view of the cylinder of FIG. 1.

Each of the two end pieces 16 and 17, as shown in FIGS. 1 and 2, comprises an inlet and outlet port 18 for fluid under pressure, which opens into the corresponding side of the chamber 11 via a main flow conduit comprising for example an annular groove 19 which opens out directly inside the chamber 11 at side face of the piece 17, or via a plurality of groove 19' in the guide bush 15 for the end piece 16 as schematically shown in FIG. 1.

From the end of FIG. 2, and in the right-hand of FIG. 1, it can also be noted that each end piece 16 and 17 is provided, on the internal side, with an annular damping pad 16', 17' as well as an adjustable needle valve 20 along a venting or restricted flow path for discharging the fluid during damping, which opens out into the piston chamber 11, on a side of annular groove 19, via a venting hole 21A, and into the groove 19 via a radial hole 21B.

The cylinder also comprises, on both sides, a damping device designed to decelerate the piston 12 along an end portion of its stroke having a substantial length suitable for defining a large air volume to be vented or discharged through the restricted flow path 21A, 21B, as explained further below.

Each damping device in the case of FIG. 1, comprises an annular closing member 22 for closing the grooves 19, 19' for the air, which closing member is coaxially arranged and is slidably movable along the rod 14 of the piston or a rear extension thereof consisting, for example, of a bush 14A screwed onto the rod end at the opposite side of the piston member 12.

Figure 3:
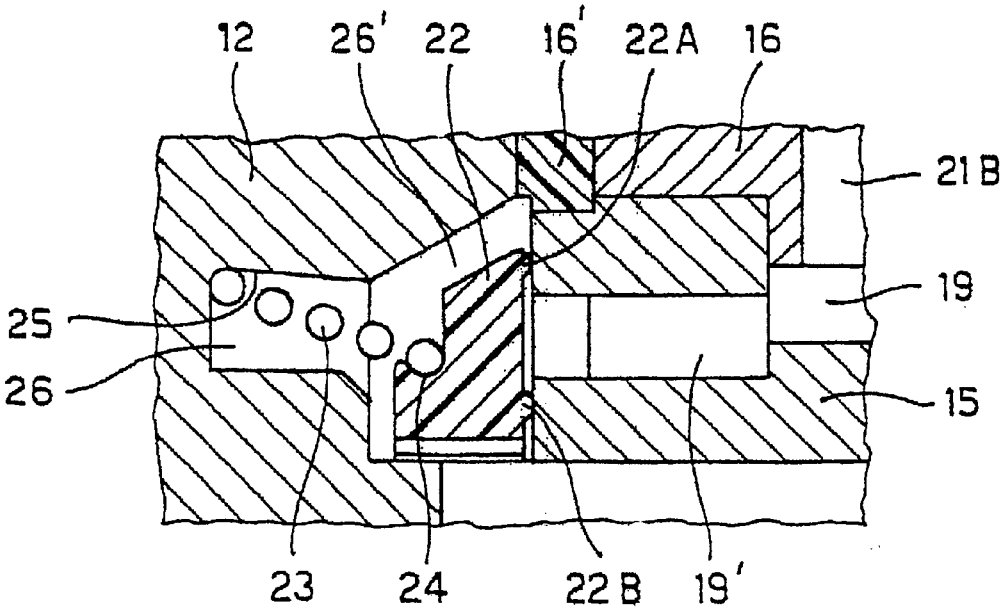
FIG. 3 is an enlarged detail of the damping device according to FIG. 1, at the end of the piston stroke.

According to the present invention, as shown in FIG. 1 and in the enlarged detail of FIG. 3, the annular closing element 22 is freely and slidably supported manner in the axial direction of the rod 14 by a helical spring 23; on one side, the spring 23 engages inside an annular groove 24 on a shoulder at the rear side of the closing member 22, while at the other end the spring 23 is retained by a conical surface 25 of an annular groove 26 provided in the corresponding end face of the piston 12; the annular groove 26 defines part of a cavity which opens at the front side of the piston 12 for housing the spring 23 in the compressed condition and the annular closing member 22 at the end of a piston stroke 12, as shown in the right side of FIG. 1 and FIG. 3.

The spring 23 may have any suitable shape; however, it is preferable that the spring 23 should have a conical shape tapering towards the annular closing member 22 so as to reduce the axial length thereof in the compressed condition of the spring, at the end of the stroke of the piston 12 where the annular closing member 22 and the spring 23 are housed inside the groove 26 and a conical shaped annular recess 26' which widens out towards the front face of the piston 12 so as to conform with the closing member 22, as shown in FIG. 1 and in the enlarged detail according to FIG. 3.

The annular closing element 22 may have any suitable shape, for example it may have a conical peripheral surface tapering towards the cavity 26' of the piston 12; in this way the entry movement of the closing member 22, at the end of the piston stroke, is facilitated; furthermore the inner diameter of the annular member 22 is slightly greater than the diameter of the rod 14 or bush 14A, to avoid frictional force while at the same time allowing a guiding action for the annular member 22 by the outer surface of the rod 14 or bush 14A.

Similarly, the closing member 22 may have a flat or differently shaped front surface intended to contact with the front face of each end piece 16 and 17 so as to form a seal with respect to the annular groove 19 and the set of grooves 19', respectively.

In order to improve the sealing action of the closing member 22 against the end piece 16 and 17 from the beginning of the deceleration stroke of the piston 12, i.e. when the spring 23 starts to be compressed by the forwards movement of the piston 12, exerting a relatively weak thrust, the annular member 22, as shown in FIG. 3 may be provided on its front face with two slightly projecting annular ribs 22A and 22B, on the external and the internal edge, respectively; in this way an adequate sealing pressure of the closing member 22 against the end pieces 16 and 17 is ensured, whatever the axial thrust exerted by the support spring 23.

Figure 4:
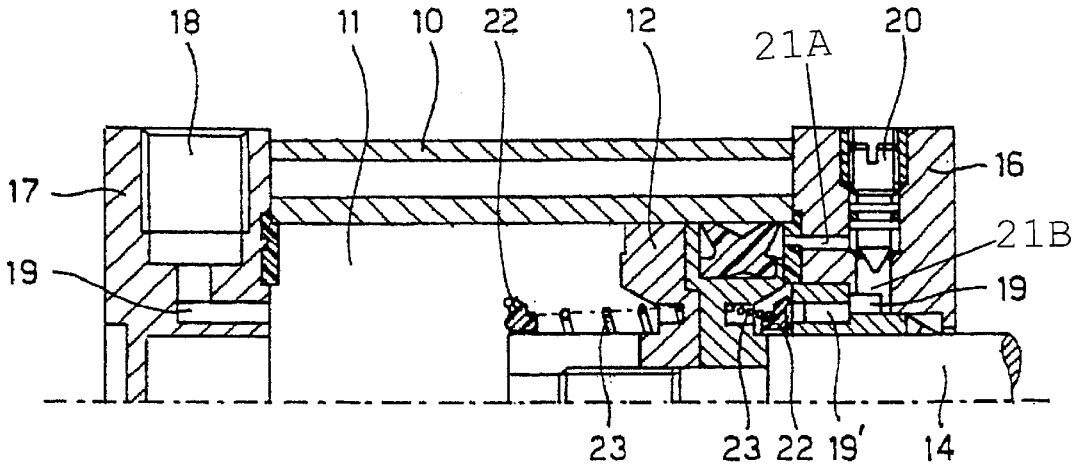
FIGS. 4, 5 and 6 show three successive conditions of the damping device according to FIG. 1, during the reciprocating movement of the piston.
Figure 5:
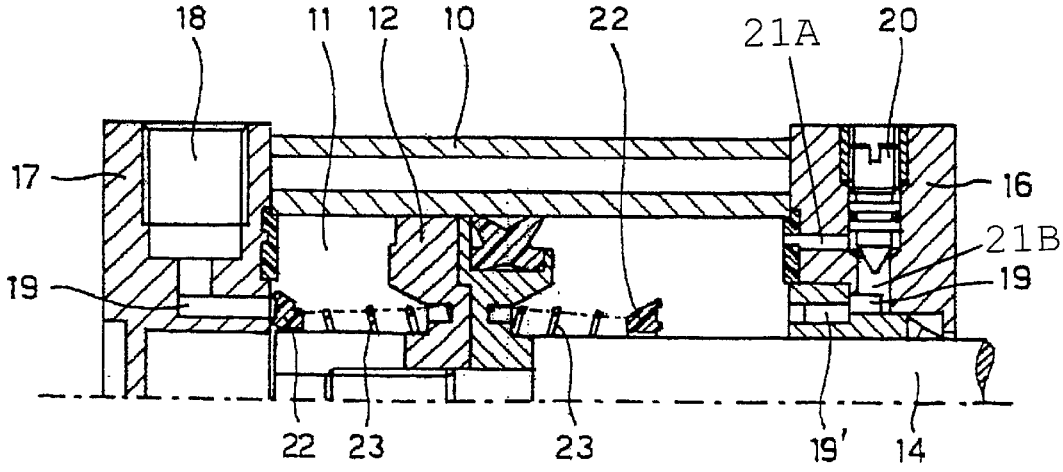
Figure 6:
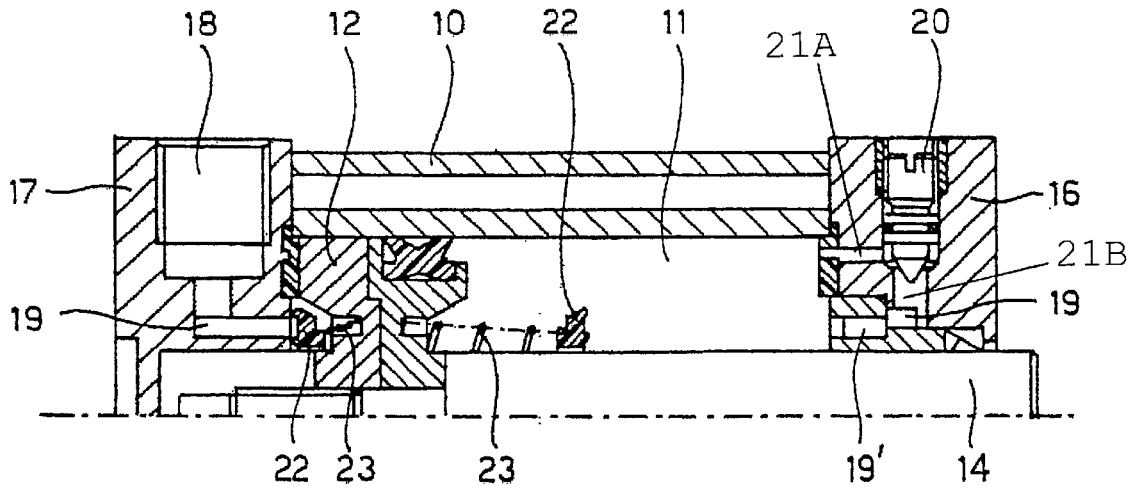

FIGS. 4, 5 and 6 show three different operative conditions of the cylinder and the working mode of the damping device according to the present invention.

In particular, FIG. 4 shows the condition of the piston 12 and damping device at the end of the stroke, in which the piston 12 urge against the right-hand end piece 16 where the closing member 22 and the spring 23 are totally inside the front cavity of the piston 12 and where the said annular member 22 closes the grooves 19', 19 for supplying and discharging the air.

Starting from this condition, by supplying pressurize air through the port 18 (not shown) of the end piece 16, the piston 12 will start to move along the chamber 11, being displaced towards the end piece 17; during the displacement, the spring 23 on the right-hand side of the piston 12 will extend gradually without restricting the inlet for the air.

Correspondingly on the opposite side, the air under pressure inside the chamber 11 will be discharged through the groove 19 and the respective port 18.

When the piston 12 has performed length of its working stroke and must be decelerated, that is when the annular member 22 on the left-hand side of the piston 12 will come into contact with the internal surface of the end piece 17, closing the groove 19 and therefore closing the chamber 11 towards the corresponding outlet port 18 for the pressurized air.

It is obvious that the volume of compressed air which remains entrapped at the left-hand side of the chamber 11 depends on the position of the piston 12 at the beginning of the damping, namely on the axial space between the front face of the piston and the annular closing member 22, which in turn depends on the length of the spring 23 in the extended condition.

Therefore, by suitably calculating the pitch and the number of coils of the spring 23 during the designing, it is possible to define the volume of air contained in chamber 11 which may be vented and discharged through the channels 21A, 21B, as previously mentioned. In this way, by adjusting the throttling valve 20, depending on the volume of air to be vented, it will be possible to control the speed and the length of the deceleration stroke of the piston 12 so that the latter comes into abutment against the annular pad 17' at an extremely low speed, reducing the impact forces as far as possible.

An intermediate condition during deceleration of the piston 12 is shown in FIG. 5.

Continuing the leftwards stroke of the piston 12, the spring 23 will be gradually compressed pushing the annular member 22 in an increasingly sealed manner against the end piece 17 so as to allow venting of the air through the corresponding narrow passageway 21A and 21B and the valve 20 provided in the end piece 17 in a manner corresponding to that of the other end piece 16. During the forward movement of the piston 12, the spring will be gradually compressed and its turns will bunch up inside the front cavity 26, 26' of the piston until the latter stops up against the annular pad 17' of the end piece 17. This condition is shown in FIG. 6 of the accompanying drawings in which it can also be seen that the entire spring 23 and the closing member 22 are totally inside the cavity of the piston 12.

According to the above, it is therefore possible to keep the dimensions of the cylinder 10 within standard values which are entirely independent of the presence and the features of the damping device, and at the same time it is possible to use a damping device which is extremely simplified and which may be modified so as to vary the deceleration of the piston and the length of the final section of the piston stroke, by simply varying the features of the spring 23; in fact, by modifying the number and the pitch of the coils, as well as the diameter of the steel wire used to form the spring 23, it is possible to vary the length of the final damping portion of the piston stroke and hence the volume of air to be vented.

Figure 7:
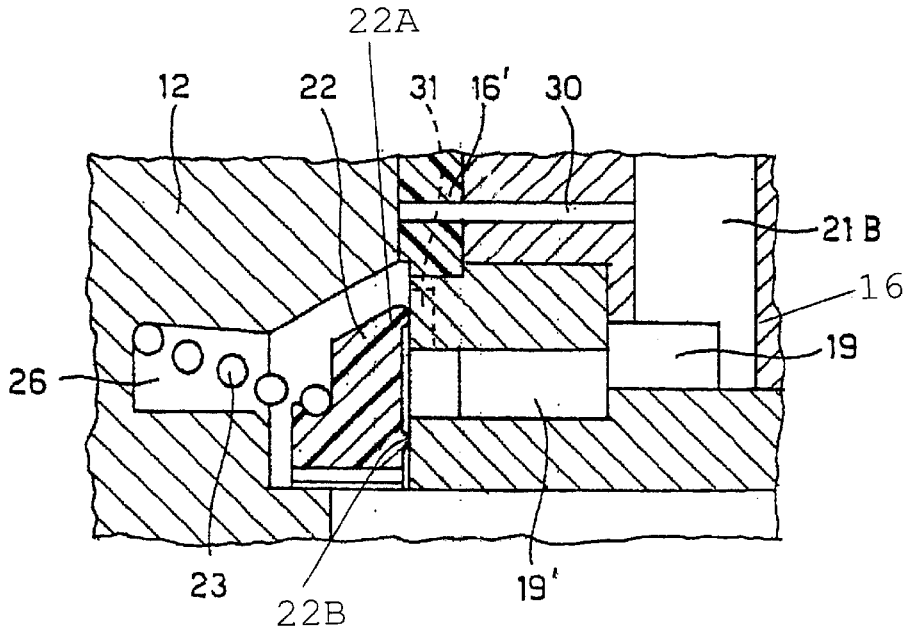
FIG. 7 shows another possible solution for venting or discharging the pressurized fluid during damping.

FIG. 7 of the accompanying drawings shows one of the possible variants for the air venting path, the other characteristics of the cylinder illustrated above and the mode of operation thereof remaining unchanged.

As shown in FIG. 7, by way of replacement of the narrow passageway 21A, 21B comprising the throttling valve 20 as illustrated in FIGS. 4–6, it is possible to envisage in each of the two end pieces 16, 17 one or more narrow slots 30 peripherally arranged around the closing member 22; the slots 30 communicate directly with the chamber 11 of the cylinder and respectively with the duct 21B and port 18 of FIGS. 4–6 for inlet and outlet of the pressurized air. As an alternative to the slots 30, other solutions are possible, envisaging for example narrow radial slits along the edges 22A, 22B of the closing member 22 or on the front surface of the end piece 16 as schematically shown in broken lines 31 in FIG. 7. Corresponding modifications could be made to end piece 17 illustrated in FIGS. 4–6.

With reference now to FIGS. 8 to 11, we shall describe a second embodiment of a damping device according to the invention, in particular suitable for a rodless cylinder.

The structure of a rodless pneumatic cylinder is generally known for example from the prior documents previously mentioned, to which specific reference is made to describe the features and working of the same cylinder; therefore the cylinder has been shown partially with regard to its main elements and will be described briefly hereinbelow with reference to FIGS. 8 to 11 of the accompanying drawings.

In general a rodless cylinder comprises a tubular body 35 which is closed at each of its ends, by an end piece 36 and is provided with a longitudinal slot closed by an bottom strip 37 and a upper strip 38, fastened into seats of the end piece 36, as shown.

A carriage 39 for connection to an external load travels along the body 35 of the cylinder; the carriage 39 is connected in any suitable manner, to a piston 40 which reciprocates inside the chamber 41 of the cylinder.

The upper closing strip 38 during the reciprocating movement of the piston 40 is folded upwards through a corresponding channel in the carriage 39, while the bottom strip 37 is folded downwards through a corresponding channel 42 at the end 43 of the piston 40.

The end piece 36 of the cylinder also comprises a central opening 44 which, via a channel 45, communicates with one side of the chamber 41 of the cylinder and also has a lateral opening 46 which communicates with the other side of the chamber 41 via a duct 47 in the body 35 of the cylinder.

Figure 8:
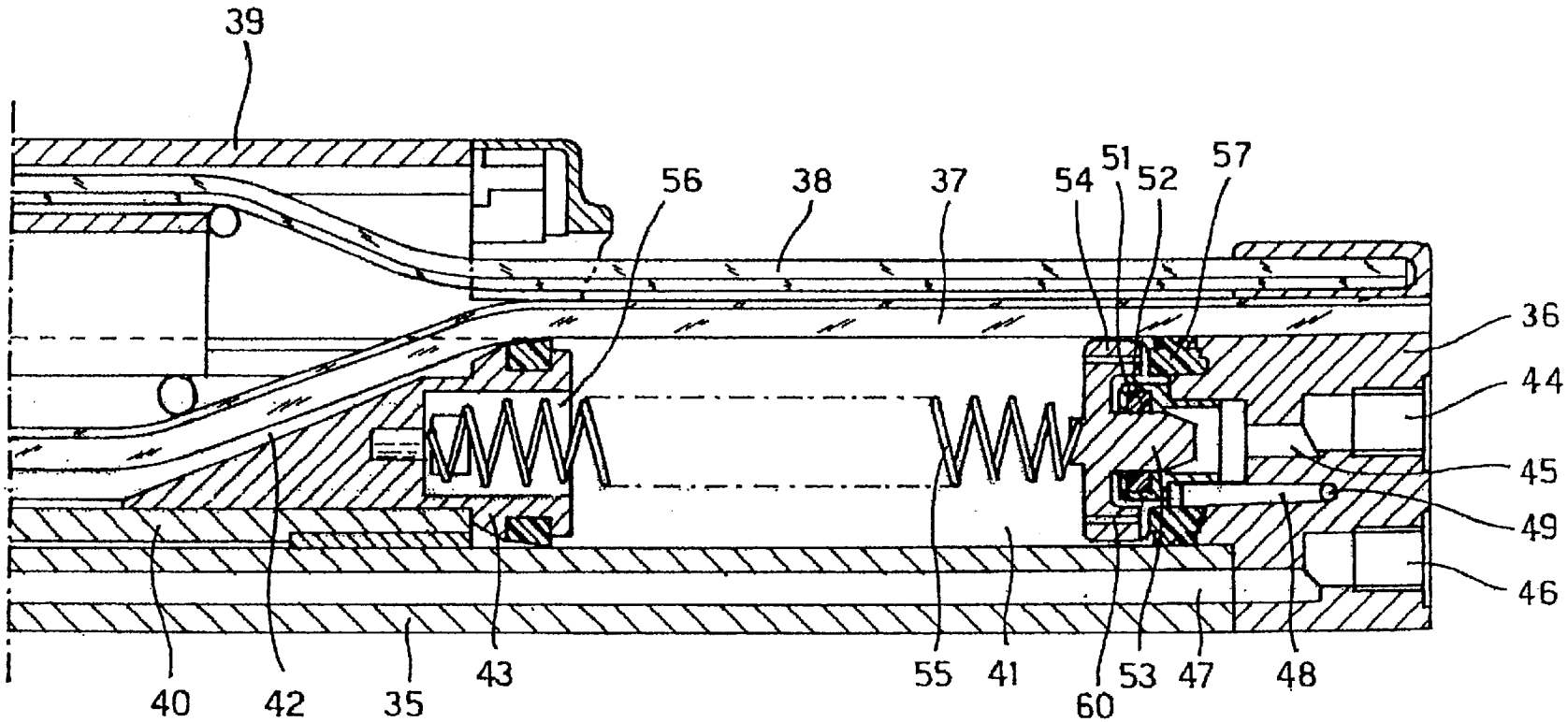
FIG. 8 shows a solution of the damping device for a rodless cylinder, in a first operative condition, at the beginning of the piston deceleration phase.

Each end piece 36 (only one is shown in FIG. 8) also comprises a venting hole 48 which communicates with the inlet-outlet port 44 or 46 for supplying or discharging the pressurized air via a channel 49 comprising a throttling valve 50 (FIG. 10), for example a needle valve which may be suitably adjusted so as to vary the venting and the deceleration of the piston.

Figure 11:
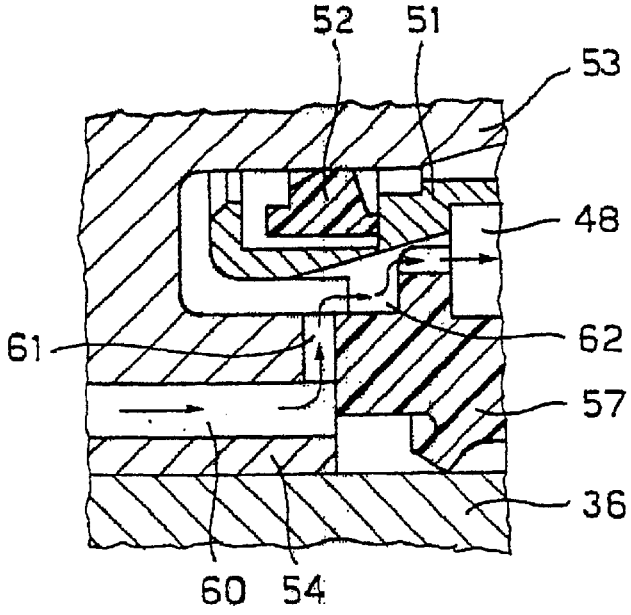
FIG. 11 shows an enlarged detail of FIG. 8.

As shown in the cross-sectional view of FIG. 8 and in the enlarged detail of FIG. 11, the air inlet-outlet port 44 (FIGS. 8–10) of the end piece 36 or the port 46 (FIGS. 8–10) for the other end block communicates with the chamber 41 via a bush 51 having a seat for housing an annular seal 52 designed to form a seal with a stud 53 integral with a guide shoe 54 defining a slidable closing member inside the chamber 41 of the cylinder.

Figure 9:
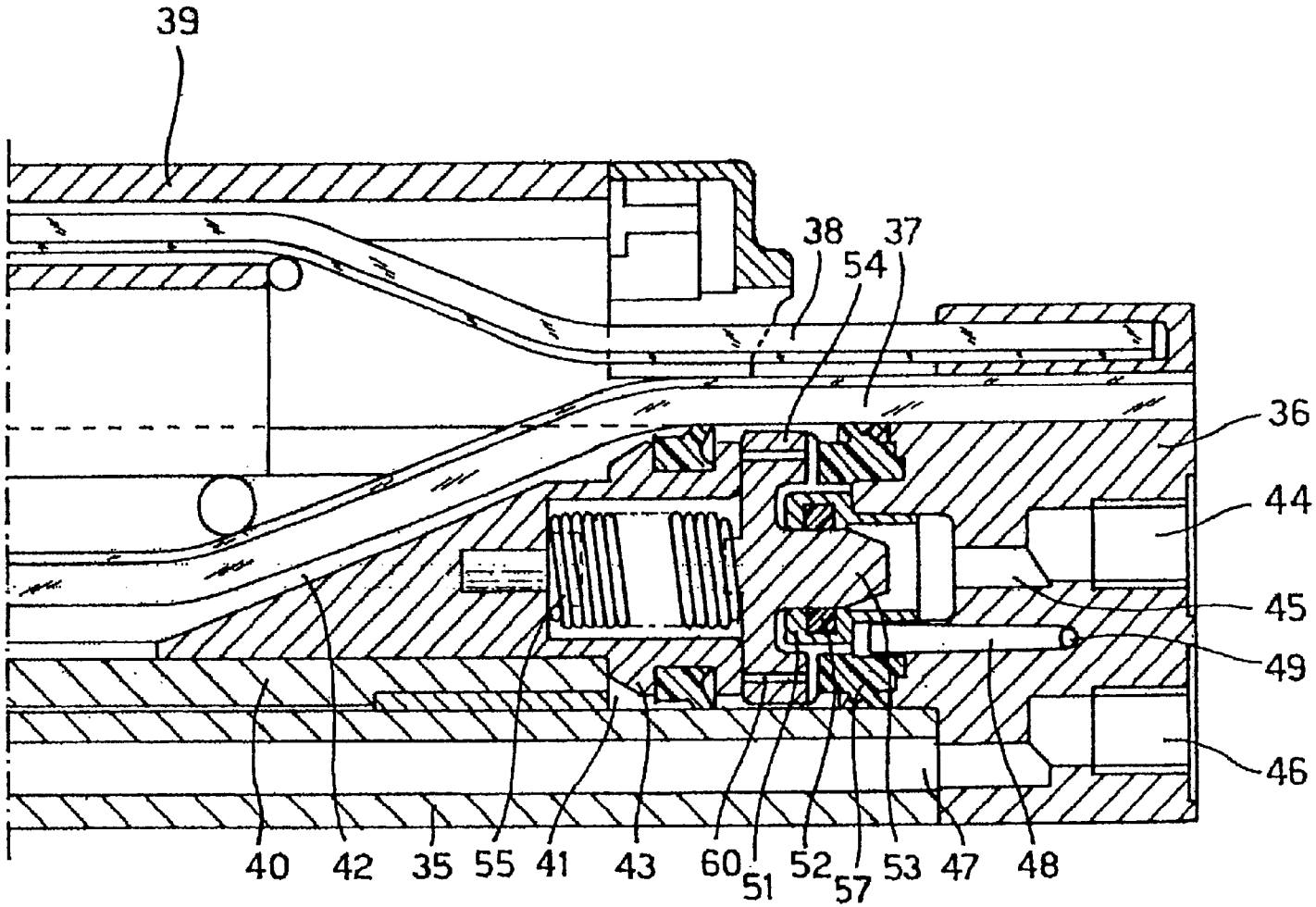
FIG. 9 shows the damping device according to FIG. 8 in a second operative condition, at the end of the piston stroke.
Figure 10:
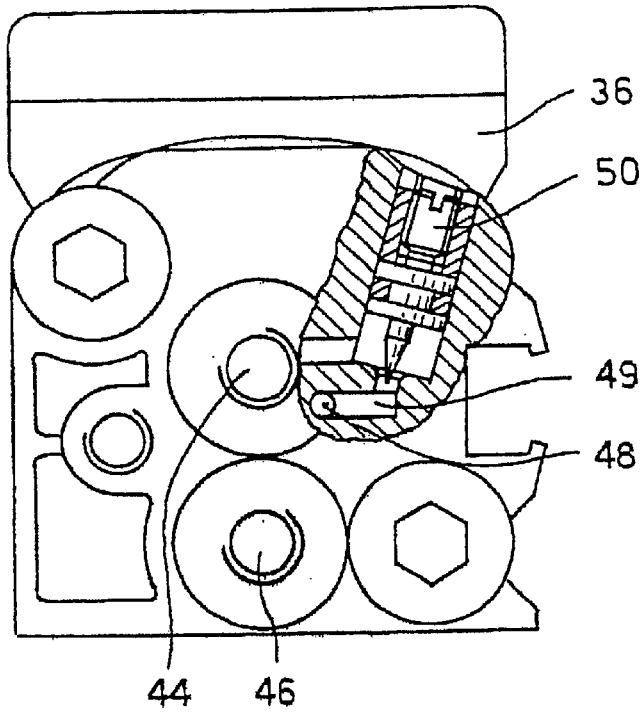
FIG. 10 shows an end view of the cylinder, with a part sectioned.

The sliding shoe 54 is connected by means of a helical spring 55, to the end 43 of the piston 40, inside a cavity 56 to receive the spring 55 in the compressed condition, at the end of the piston stroke; this detail is illustrated more fully in the corresponding cross-section according to FIG. 9.

Finally, 57 in the various figures denotes a damping pad which is housed in a seat inside each end piece 36 of the cylinder.

As shown in FIGS. 8 and 9 and in the enlarged detail of FIG. 11, near its peripheral edge, the guide shoe 54 has one or more axial holes 60 which on one side open out inside the chamber 41 of the cylinder, whereas on the opposite side they communicate with radial channels 61 formed in the front face of the damping pad 57 so as to form, together with a slit 62 on the external edge of the sleeve 51, a venting path towards the hole 48 and towards the throttling valve 50.

The damping device for rodless cylinders according to FIGS. 8 to 11 operates substantially in the same manner as the device previously described with regard to a cylinder with rod; irrespective of the different structure of the cylinder as a whole and the element for closing the path supplying and discharging the compressed air, the only difference in the case of FIGS. 8 to 11 consists in that the end 43 of the piston is provided with a cavity for receiving only the spring 55 connected to the guide shoe 54 for the closing member 53.

In this case as well, therefore, it is possible during the design stage to calculate the features of the spring so as to obtain the desired degree of deceleration of the piston 40 and venting of a given volume of air.

The characteristics of the piston deceleration and air venting may again be modified at any moment, both during the design stage and during construction and the use of the cylinder, by simply replacing a type of spring with a spring of different type, without having to modify or replace any other parts of the cylinder.

The scope of the present invention obviously includes other possible solutions or applications which are different from those illustrated above: for example, by way of replacement of the annular pad element of the first example of FIGS. 1 to 6, it is possible to use a cone-shaped annular pad member intended to form a seal with the internal edge of an annular seal housed in a seat of the end piece of the cylinder. In this case also, the annular member will be connected to the piston by means of a spiral spring which extends coaxially and along the piston rod or along a guide bush as previously referred to.

Obviously other specific solutions are possible without departing from the general principles of the present invention which essentially consists in providing a damping device for pneumatic cylinders consisting of an element for closing the channel supplying and discharging the air under pressure, however formed, connected to the cylinder piston by means of a helical spring which extends freely from the end of the piston itself and in providing a cavity suitable for containing the volume of the spring in its compressed condition and/or the said element for closing the air duct during the final deceleration section of the piston.

It is understood, therefore, that that which has been stated or illustrated with reference to the accompanying drawings has been provided purely by way of a non-limiting example of the present invention.

What we claim is:

1. A pneumatic cylinder comprising a cylindrical body defining an elongated piston chamber having an inlet and outlet port for pressurized fluid, opening into the piston chamber at least one end thereof; a reciprocable piston member in said piston chamber; a closing member connected to the piston member for closing the fluid inlet and outlet port, a damping device comprising said closing member and a restricted flow path for discharging the pressurized fluid upon closure of the inlet and outlet port by said closing member and a restricted flow path for discharging the pressurized fluid upon closure of the inlet and outlet port by said closing member, and guide means for frictionless guiding of the closing member inside the piston chamber, the guide means comprising a sliding shoe for supporting the closing member, sliding inside the piston chamber, wherein said closing member is coaxially arranged and movably supported by a helical spring, in respect to the piston member, and in that said piston member comprises an open cavity at one end thereof to receive at least a portion of the closing member and the helical support spring upon closure of the inlet and outlet port by said closure member during a final portion of the piston stroke.

2. A rodless cylinder according to claim 1, wherein the closing member is connected to one end of a helical spring which freely extends from one end of the piston member.

3. A rodless cylinder according to claim 2, wherein the helical spring extends from inside of a cavity at a front end of the piston member.

4. A pneumatic cylinder comprising a cylindrical body defining an elongated piston chamber having an inlet and outlet port for pressurized fluid, opening into the piston chamber at least one end thereof through an annular groove; a reciprocable piston member in said piston chamber having a piston rod; a closing member on the piston member for closing the fluid inlet and outlet port, a damping device comprising said closing member and a restricted flow path for discharging the pressurized fluid upon closure of the inlet and outlet port by said closing member and a restricted flow path for discharging the pressurized fluid upon closure of the the inlet and outlet port by said closing member, and guide means for frictionless guiding of the closing member which axially extends inside the piston chamber, the guide means comprising the piston rod or extension thereof, wherein said closing member is coaxially arranged and movably supported by a helical spring, in respect to the piston member, and in that said piston member comprises an open cavity at one end thereof to receive at least a portion of the closing member and helical support spring upon closure of the inlet and outlet port by said closure member during a final portion of the piston stroke; wherein the closing member comprises an annular shaped member coaxially movable in respect to the piston rod or extension thereof; and wherein the annular closing member comprises annular ribs facing the annular groove on a flat surface at the end of the piston chamber, to close the inlet-outlet port.

5. A cylinder according to claim 4, wherein the helical spring comprises a conically shaped body tapering in the direction of the closing member.

6. A cylinder according to claim 4, wherein the helical spring is disengageably connected inside the cavity of the piston member, and to the closing member for the fluid inlet and outlet port.

7. A cylinder according to claim 4, wherein the restricted flow path comprises an adjustable throttling valve.

8. A cylinder according to claim 4, wherein the open cavity at the end of the piston member comprises an annular groove, to contain the spring member, which opens out into an annular cavity for housing the closing member for the inlet and outlet port.

* * * * *